US005820281A

United States Patent [19]

Hill et al.

[11] Patent Number: 5,820,281

[45] Date of Patent: Oct. 13, 1998

[54] PRINTER WITH DISCRETE SHEET LOAD ENHANCEMENT APPARATUS AND METHOD

[75] Inventors: Jeffery L. Hill, Mundelein; Gregory S. Hill, Lake Zurich, both of Ill.

[73] Assignee: Dynetics Engineering Corporation, Lincolnshire, Ill.

[21] Appl. No.: 859,295

[22] Filed: May 20, 1997

Related U.S. Application Data

[63] Continuation-in-part of Ser. No. 521,350, Aug. 29, 1995.

[51] Int. Cl.[6] ..... B41J 11/70

[52] U.S. Cl. ..... 400/621; 400/605; 400/624

[58] Field of Search ..... 400/605, 624, 400/629, 593, 613.2, 613.3, 621; 225/100, 96; 271/10.11, 110; 347/104, 105

[56] References Cited

U.S. PATENT DOCUMENTS

| | | | |
|---|---|---|---|
| 4,909,648 | 3/1990 | Hartman et al. | 400/234 |
| 5,133,615 | 7/1992 | Saito et al. | 400/621 |
| 5,388,815 | 2/1995 | Hill et al. | 270/32 |
| 5,433,364 | 7/1995 | Hill et al. | 225/96 |
| 5,494,544 | 2/1996 | Hill et al. | 156/64 |
| 5,505,551 | 4/1996 | Rutherford | 400/621 |
| 5,509,886 | 4/1996 | Hill et al. | 493/419 |

*Primary Examiner*—Christopher A. Bennett
*Attorney, Agent, or Firm*—Potthast & Ring

[57] ABSTRACT

A single sheet printer (21) is adapted to receive continuous carrier forms for printing by a burster module (16) for separating continuous printable stock (24) into separate bursted sheets which are fed to the printer transport mechanism (12) in lieu of the single sheet storage module (24).

19 Claims, 5 Drawing Sheets

PRINTER WITH DISCRETE SHEET LOAD ENHANCEMENT APPARATUS AND METHOD

CROSS REFERENCE TO RELATED APPLICATION

This application is a continuation-in-part of U.S. patent application Ser. No. 08/521,350 filed Aug. 29, 1995 of Hill et al. entitled "Printing Assembly With Discrete Sheet Load Enhancement Apparatus and Method" which is hereby incorporated by reference.

BACKGROUND OF THE INVENTION

1. Field of the Invention

This invention relates to printing assemblies in general and, in particular, to printing assemblies for printing card carrier forms used in card insertion systems.

2. Description of the related art including information disclosed under 37 C.F.R. 1.97–1.99

Free standing single sheet printers which print selected material under control of a personal computer are widely known. These printers are provided with one or more trays for holding stacks of discrete, or single, blank sheets to be printed upon in position for pick-up by a transport mechanism which transports the single sheets through the printing apparatus, one sheet at a time. The transport mechanisms of these printers will not handle continuous forms which consist of sheets interconnected in a fan-folded stack or on a roll.

In the parent application referenced above, a conventional single sheet printer has its paper tray specially adapted to enable the printer to indirectly receive single sheets from a burster which separates single sheets from the fan-folded stack on interconnected sheets, feeds the separated single sheets, such as card carrier forms, into the tray.

Other printers are known which, in addition to the blank paper trays from which the transport system obtains blank sheets, have single sheet storage modules which hold a maximum supply of sheets that is several times the maximum capacity of the single sheet trays. Sheets are selectively transported from the discrete sheet storage module from the blank paper tray for printing. Again, however, the discrete sheet storage modules are adapted to hold only single sheets and the transport mechanism which draws sheets from the discrete sheet storage modules are only capable of transporting single sheets from the module to the printing apparatus.

Consequently, known single sheet general purpose paper printers have not been used in cooperation with card insertion systems to print card carrier forms which customarily are printed as continuous fan-folded forms connected in seriatim relationship. Known continuous carrier form printers print only on continuous forms which are subsequently separated into discrete individual forms.

SUMMARY OF THE INVENTION

It is therefore a principal object of the present invention to adapt a single sheet printer for use with continuous interconnected sheets, such as continuous card carrier forms for use in an in-line printing card insertion system which mounts to, or inserts into, cards to printed carrier forms.

The object is achieved by providing a printing assembly having a printer, a single sheet storage module mounting location for releasable attachment of a single sheet transport mechanism for automatically transporting single sheets fed to a printer inlet by the single sheet storage module with a discrete sheet load enhancement apparatus, comprising a burster module for separating continuous printable stock received at a burster inlet into separate bursted sheets fed to a burster outlet and means for releasably attaching the burster module to the printer at the single sheet storage module mounting location with the burster outlet substantially aligned with the printer inlet to directly feed the separate bursted sheets to the printer transport mechanism.

Also, the object of the invention is obtained by provision of a method of printing, comprising the steps of (1) mounting a burster module to a printer assembly at a single sheet storage module mounting location in lieu of the single sheet storage module with a burster outlet substantially aligned with a printer inlet, (2) feeding continuous printable stock to a burster inlet burster module, (3) separating with the burster module the continuous printable stock received at the burster inlet into separate bursted sheets and (4) feeding the separate bursted sheets from the burster outlet to the printer inlet for transport to the printer for printing.

Moreover, obtainment of the object is achieved by a method of converting a conventional single sheet printer to function as part of an in-line card insertion system for inserting cards into matching carrier forms, comprising the steps of (1) mounting a carrier form burster module to the printer at a mounting location for a conventional single sheet feeder module otherwise releasably attached with the single sheet printer, said carrier form buster module adapted to separate individual carrier forms from a supply of continuous stock and feed the separate carrier forms to the printer and (2) mounting a removable carrier form outlet guide especially adapted for guiding printed card carrier forms to a card inserter carrier form inlet at a mounting location for and in lieu of a conventional printer outlet tray otherwise releasably attached with the printer.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
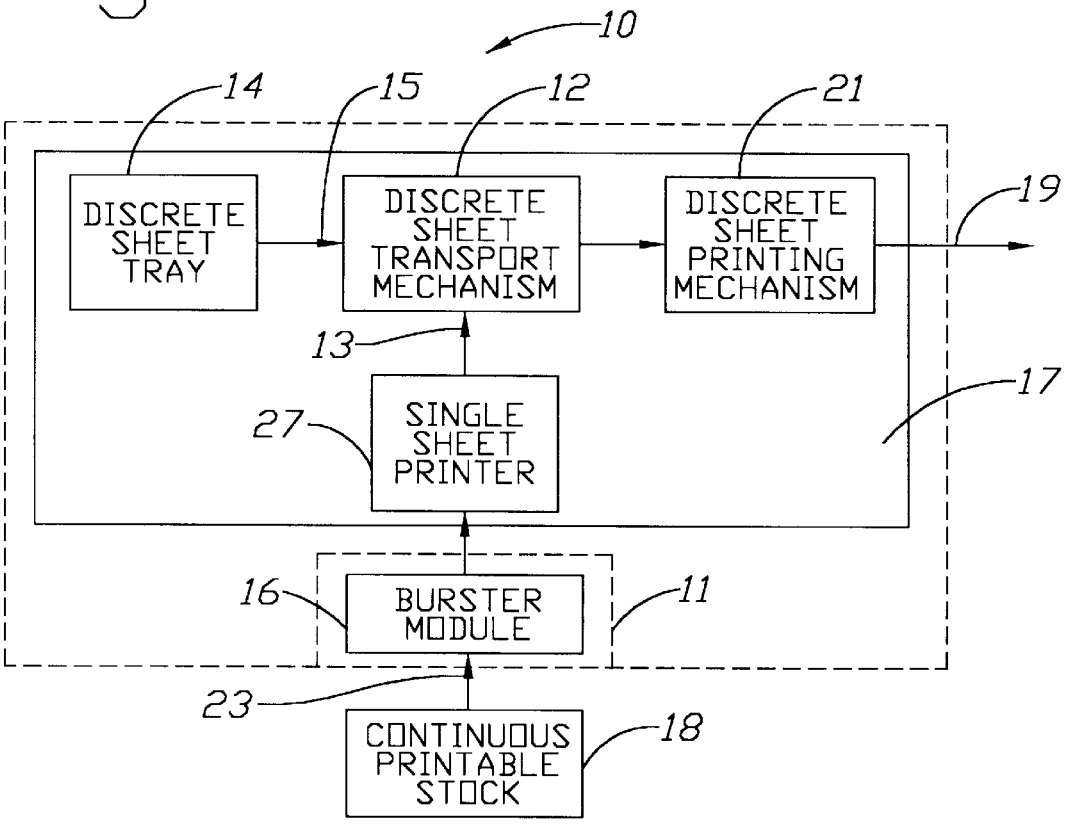
FIG. 1 is a functional block diagram of a preferred embodiment of the printing assembly with the discrete sheet load enhancement apparatus of the present invention.
Figure 2:
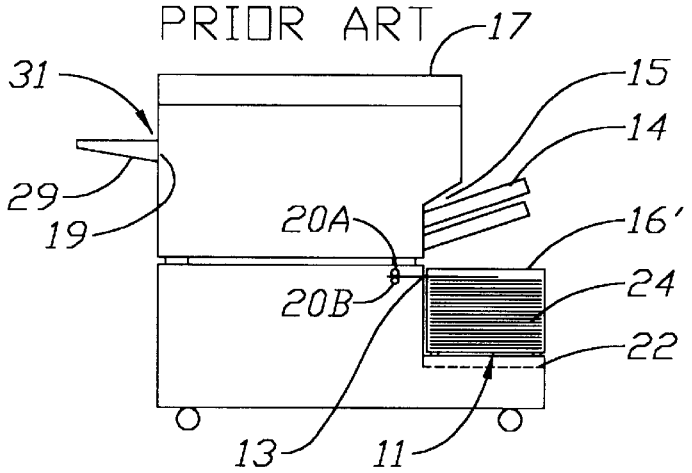
FIG. 2 is a side elevational view of a PRIOR ART printer with the both a pair of single sheet discrete trays and a single sheet storage module.
Figure 3:
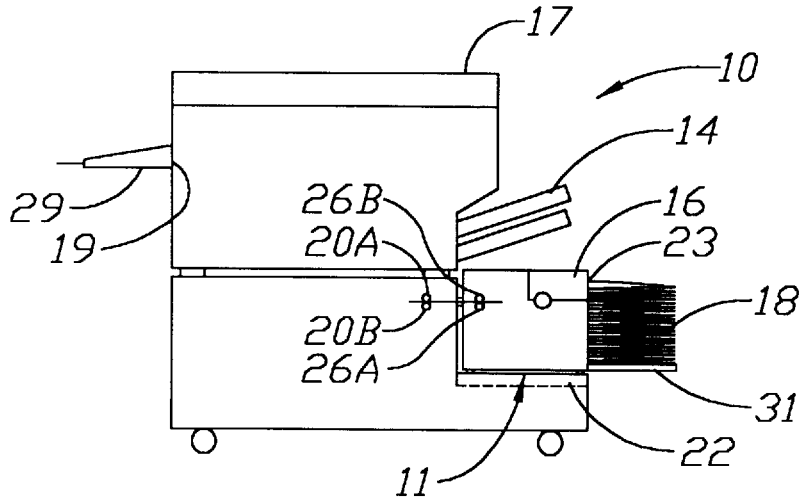
FIG. 3 is a side elevational view of the preferred embodiment of the printing assembly of the present invention shown in block form in FIG. 1 in which the print of FIG. 2 has been modified to accept continuous forms.

Referring to FIG. 1, the preferred embodiment of the printing assembly 10 of the present invention has a discrete sheet load enhancement apparatus including a burster module 16 mounted at a single sheet storage module mounting location 11 of a single sheet printer 17. The burster module 16 interfaces with a discrete sheet transport mechanism 12 of the single sheet printer 17. The discrete sheet transport mechanism 12 transports individual sheets received at an inlet 13 to a discrete sheet printing mechanism 21. A pair of pinch rollers 20A and 20B are located at the inlet 13 as seen in FIGS. 2 and 3. The discrete sheet printing mechanism 21 prints selected information onto the sheets and passes the printed sheets to a printed sheet outlet 19. The burster module 16 receives at an inlet 23 interconnected fan-folded or rolled sheets from a continuous printable stock supply module 25, separates the continuous stock into single sheets 27 and feeds them to the transport mechanism inlet 13 one sheet at a time.

The discrete sheet transport mechanism 12 also has an inlet 15 at which it receives single sheets from a discrete sheet tray 14 which are passed to the discrete sheet printing mechanism 21. Advantageously, when the discrete sheet printing mechanism 21 is not used to print card carrier forms from the burster module, it is not disabled from printing on other single sheets from the discrete sheet tray 14.

As seen in FIG. 2, in both a discrete sheet tray 14 and a single sheet storage module 16' are provided. The single sheet storage module is mounted to a slidable shelf 22 at the single sheet storage module mounting location 11 and contains a stack of discrete sheets 24. The individual sheets 24 are extracted from the single sheet storage module by means including a pair of pinch rollers 20A and 20B which feed the single sheets through the inlet 13 and into the discrete sheet transport mechanism 21. The printed sheets are produced at the outlet 19 and stacked on an outlet tray 29 releasably mounted at an outlet tray mounting location 31.

Referring now to FIG. 3, the single sheet storage module 16' is replaced by the burster module 16 and releasably attached to the slidable shelf 22 at the single sheet storage module mounting location 11. A supply of continuous printable stock of fan-folded carrier forms 18 is mounted on the carrier form support shelf. The burster module 16 separates the blank continuous carrier forms which are received at the burster inlet 23 from the continuous printable stock 18 and are fed into the printer inlet 13 and thereby to the discrete sheet printing mechanism 21. A set of pinch rollers 26A and 26B of the burster module 16 feed the carrier forms 27 into engagement with the pinch rollers 20A and 20B. The outlet tray 29 of FIG. 2 is removed and a carrier form outlet guide 42 is mounted in its place and a movably mounted bar code reader 62 is mounted above the guide 42 to read bar codes on the printed carriers 27 as they emerge from the printing mechanism 21 at outlet 19.

Figure 4:
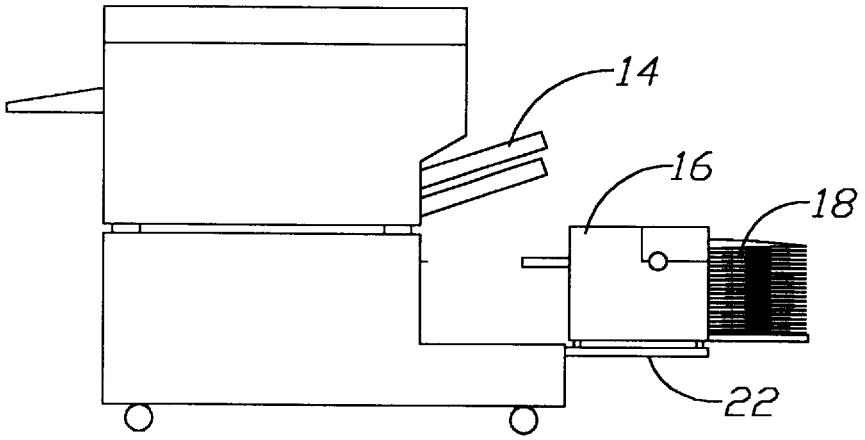
FIG. 4 is a side elevational view like that of FIG. 3 slideable but with support shelf for the burster of FIG. 1 and in the extended position.
Figure 5A:
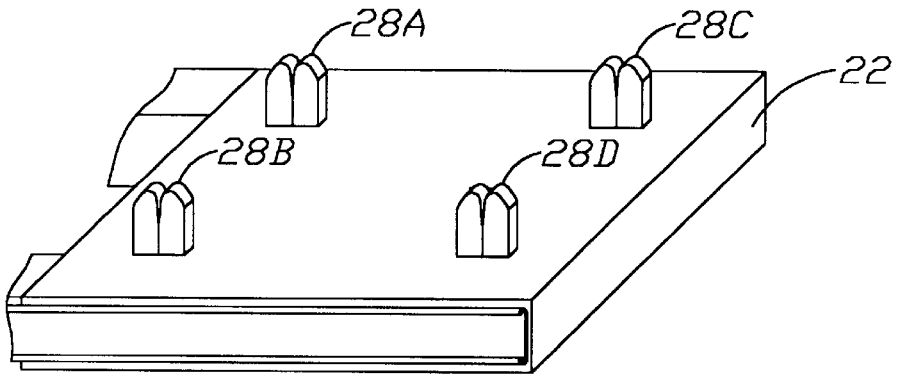
FIG. 5A is a perspective view of the support shelf showing details of the alignment posts.
Figure 5B:
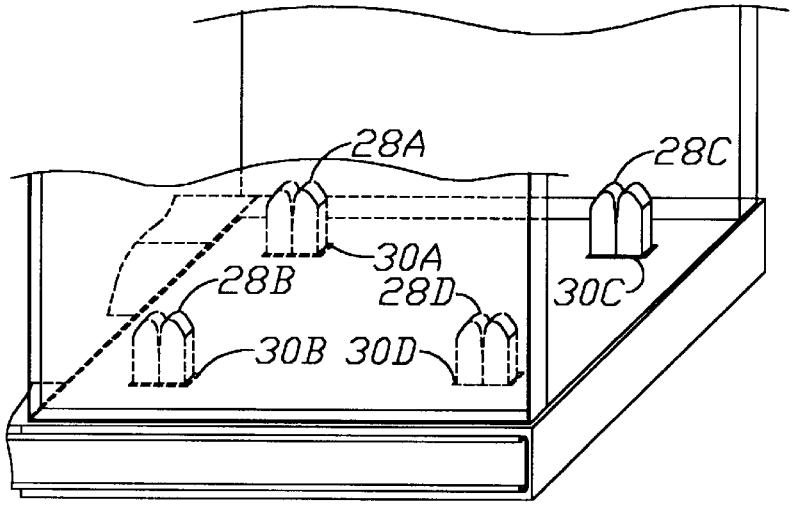
FIG. 5B is a view similar to that of FIG. 5A showing the burster stand with mating connectors mounted to the alignment posts.

FIG. 4 shows the slidable shelf 22 in an extended position for facilitating the removal of the discrete single sheet storage module 16' and mounting of the burster module 16 in its place. The slidable shelf 22 has alignment mounting pins 28A, 28B, 28C and 28D, as seen in FIG. 5A, which correspond to mounting holes on the bottom of the discrete sheet storage module 16'. The burster module 16 has a base which is provided with corresponding alignment mounting holes 30A, 30B, 30C and 30D for releasably attaching the burster module 16 to the slidable shelf 22. FIG. 5B shows the burster module 16 mounted to the slidable shelf 22 with mounting pins 28A, 28B, 28C and 28D received through the mounting holes 30A, 30B, 30C and 30D, respectively, located in the bottom of the burster module housing.

Figure 6A:
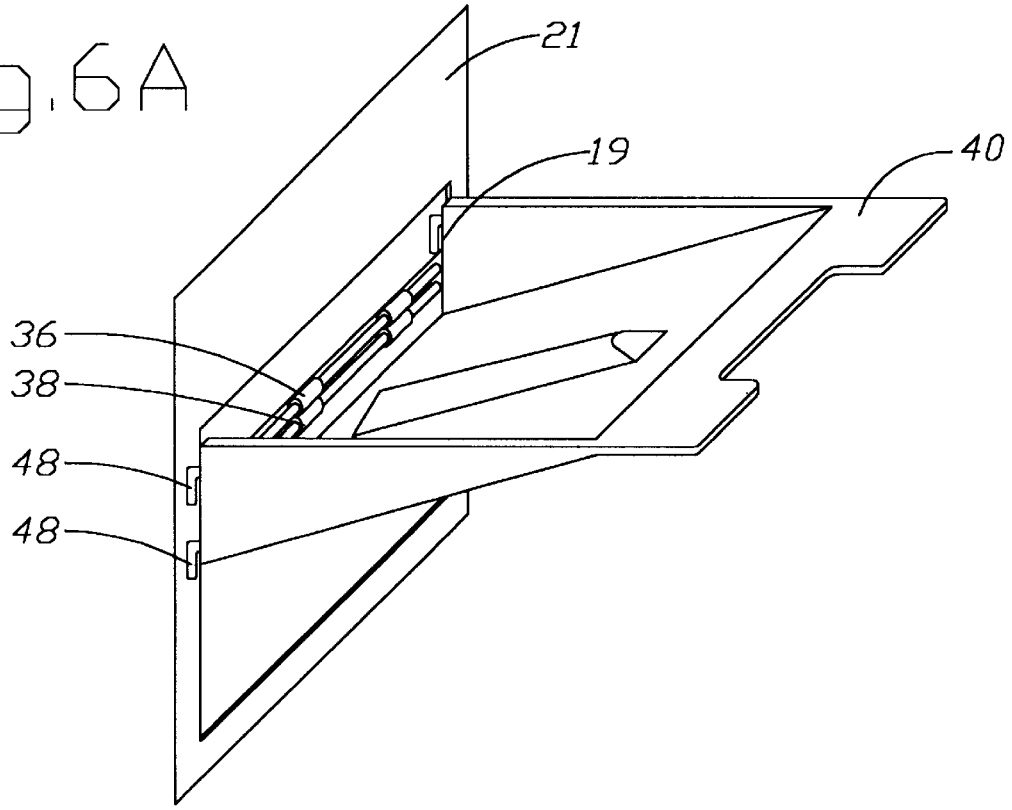
FIG. 6A is a perspective view of a PRIOR ART paper outlet tray movably mounted to the PRIOR ART printer of FIG. 2.
Figure 6B:
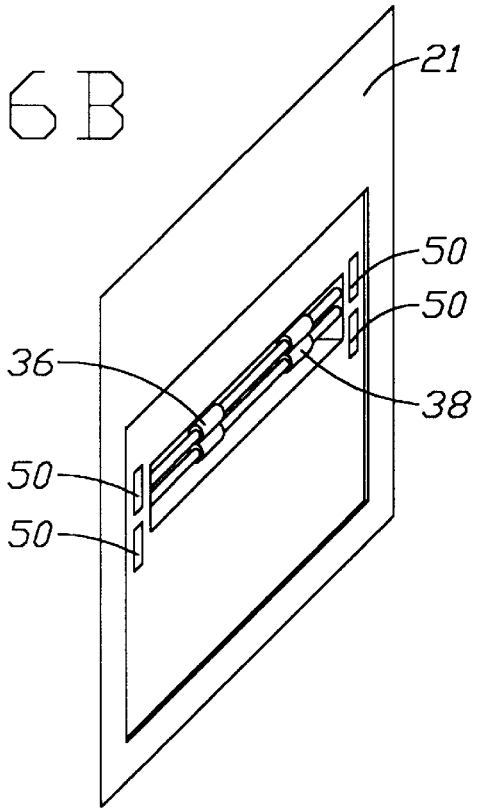
FIG. 6B is a perspective view of the PRIOR ART printer paper outlet with the paper outlet tray removed.

Referring now to FIG. 6A, the PRIOR ART printer outlet 19 in which pinch rollers 36 and 38 feed carrier forms from the printing mechanism 21 into a PRIOR ART outlet tray 40 which receives and supports printed sheets. The outlet tray 40 is releasably mounted to the printer outlet 19 by means of two pairs of mounting hooks 48 which mount into corresponding mounting holes 50, seen in FIG. 6B.

Figure 6C:
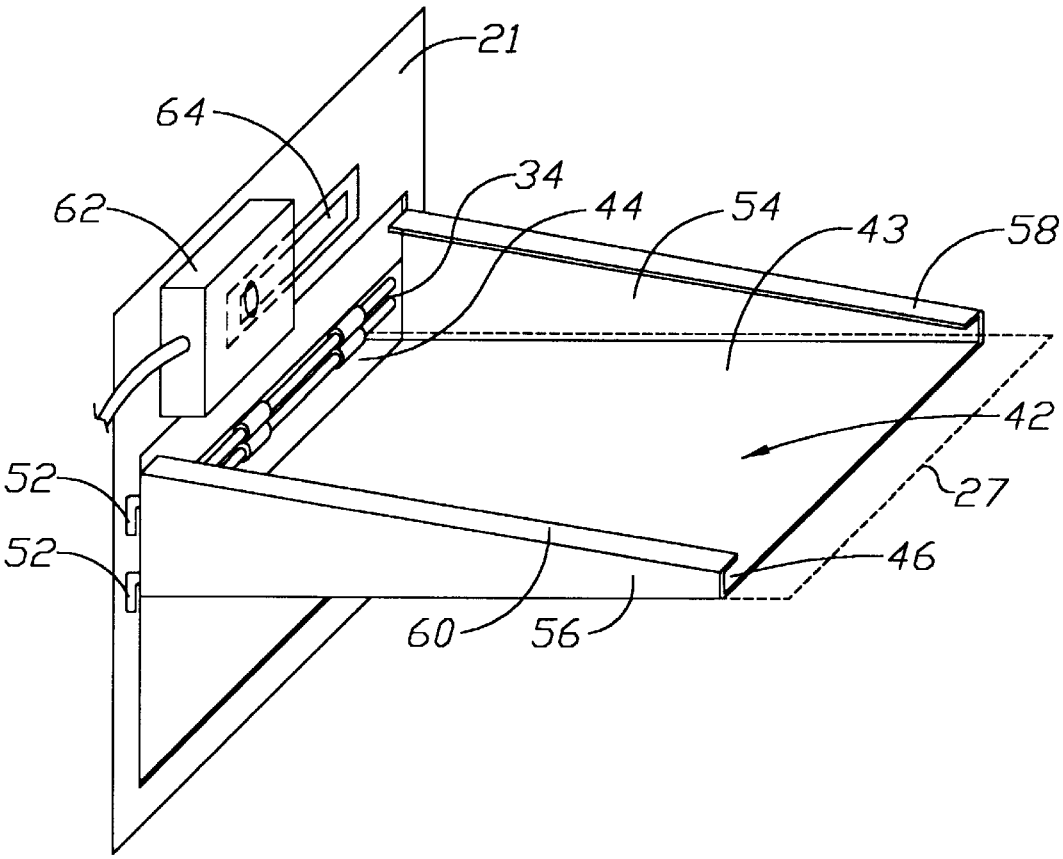
FIG. 6C is a perspective view of the printer paper outlet of FIG. 6B but with a carrier form guide assembly mounted to the printer of FIG. 2 in lieu of the PRIOR ART paper outlet tray of FIG. 6B and movably mounted bar code reader.

Referring to FIG. 6C, the carrier form outlet guide 42 for guiding printed carrier forms from the printer outlet 19 to an inserter inlet of a card inserter (not shown) is releasably mounted to the discrete sheet printing mechanism 21 in lieu of the outlet tray 29 by means of mounting hooks 52 which releasably fit into mounting holes 50.

The carrier outlet guide 42 has a horizontal floor 43 with a pair of open ends 44 and 46. Open end 44 is adjacent the printer outlet 19 for receipt of the printed carrier forms 27 while open end 46 interfaces with an inserter inlet for insertion into the inserter (not shown). A pair of side walls 54 and 56 have inwardly turned members 58 and 60 for restraining the carrier forms 27 against vertical movement within the guide member 42. The bar code reader 62 is adjustably mounted adjacent the printer outlet 19 to read printed bar code information on the carriers as they emerge from the printer outlet 19. The bar code reader 62 is slideably mounted to a slot 64 for movably adjusting the bar code reader across at least a portion of the width of the outlet carrier guide 42.

It should be appreciated that to the extent the details of the various apparatus referred to or shown herein are not described or shown herein, they form no part of the present invention. If such details are desired, reference should be made to one or more of U.S. Pat. No. 5,388,815 issued Feb. 14, 1995 to Hill et al. entitled "Embossed Card Package Production System With Modular Inserters For Multiple Forms"; U.S. Pat. No. 5,433,364 issued Jul. 18, 1995 entitled "Card Package Production System With Burster and Carrier Verification Apparatus"; U.S. Pat. No. 5,494,544 issued on Feb. 27, 1996 to Hill et al. entitled "Automatic Verified Embossed Card Package Production Methods"; U.S. Pat. No. 5,509,886 issued Apr. 23, 1996 to Hill et al. entitled "Card Package Production System With Modular Carrier Folding Apparatus For Multiple Forms"; and U.S. Pat. No. 5,541,395 issued Jul. 30, 1996 to Hill et al. entitled "Card Package Production System With Burster and Code Reader. Reference should also be made to U.S. patent application Ser. No. 08/313,548 filed Sep. 23, 1994 (which is a continuation of filewrapper of Ser. No. 08/036,436 filed Mar. 24, 1993) of Hill et al. entitled "Card Carrier Forms For Automated Embossed Card Package Production System"; U.S. provisional patent application Ser. No. 60/047,195 (DYN-11) of Hill et al. entitled "Card Inserter With Carrier Folding Apparatus Method" filed contemporaneously herewith; U.S. provisional patent application Ser. No. 60/047,190 (DYN-12) of Hill et al. entitled "Automatic Card Insertion System With Card Multireader and Method" filed contemporaneously herewith; U.S. patent application Ser. No. 08/859,685 (DYN13) of Hill et al. entitled "Inserter Module Adaptable For Use With Both Preprinted and In-Line Printed Carriers and Method" filed contemporaneously herewith; and U.S. provisional patent application Ser. No. 60/047,189 (DYN-15) of Hill et al. entitled "Card Package Production System With A Multireader Card Track and Method" filed contemporaneously herewith. All these patents and patent applications are hereby incorporated by reference.

While a detailed description of the preferred embodiment of the invention has been given, it should be appreciated that many variations can be made thereto without departing from the scope of the invention as set forth in the appended claims.

We claim:

1. In a printing assembly having a printer, a printer inlet, a single sheet storage module mounting location for releasable attachment of a single sheet transport mechanism for automatically transporting single sheets fed to a printer inlet by the single sheet storage module, the improvement being a discrete sheet load enhancement apparatus, comprising:

a burster module for separating continuous printable stock received at a burster inlet into separate bursted sheets fed into a burster outlet; and means for releasably attaching the burster module to the printer at the single sheet storage module mounting location with the burster outlet substantially aligned with the printer inlet to directly feed the separate bursted sheets to the printer transport mechanism.

2. The printing assembly of claim 1 in which said single sheet transport mechanism has pinch rollers at the printer inlet, and said burster module feeds the bursted sheets into engagement with the pinch rollers.

3. The printing assembly of claim 1 in which said continuous printable stock is a supply of interconnected carrier forms.

4. The printing assembly of claim 1 in which said printing assembly includes a printer outlet, and means for releasably mounting an outlet tray adjacent the printer outlet to receive and support printed sheets from the printer outlet, and a carrier form outlet guide assembly including a guide member for guiding printed carrier forms from the printer outlet to an inserter inlet, and means carried by the guide member and compatible with the outlet tray mounting means for mounting the guide member to the printer adjacent the printer outlet to guide the carrier form into the inserter inlet.

5. The printing assembly of claim 1 in which said printer has means for releasably mounting an outlet tray adjacent the printer outlet to receive and support printed sheets from the printer outlet, and including a carrier form outlet guide assembly with a guide member for guiding printed carrier forms from the printer outlet to an inserter inlet, and means carried by the guide member and compatible with the outlet tray mounting means for mounting the guide member to the printer adjacent the printer outlet to guide the carrier form into an inserter outlet.

6. The printing assembly of claim 5 in which the guide member has a floor with a pair of open ends, and a pair of side walls on opposite sides of the floor.

7. The printing assembly of claim 6 in which the pair of side walls have tops, and said guide member includes inwardly turned tabs to restrain the carrier forms to move along the floor adjacent the open end.

8. The printing assembly of claim 4 includes a sensor for reading information printed on the carrier, and means for mounting the sensor to the printer to read the information on the printed carrier forms.

9. The printing assembly of claim 8 in which said sensor is a bar code reader for reading bar coded information on the printed carrier forms.

10. The printing assembly of claim 8 in which the sensor is a remote sensor mounted at a location spaced from the printed carrier forms.

11. The printing assembly of claim 10 in which the sensor is mounted to the printer at a location adjacent the printer outlet to read the information as the printed carriers emerge from the printer outlet.

12. The printing assembly of claim 8 in which said mounting means includes means for the sensor mounting the sensor to different positions on the printer relative to the carrier forms to read the information from the carrier forms at different locations on the carrier forms.

13. The printing assembly of 1 including a pair of mounting members attached to the printer and in which the releasably attaching means includes a pair of alignment members carried by the burster module releasably interconnectable with the corresponding pair of mounting members attached to the printer to insure proper alignment of the printer inlet with the burster inlet.

14. A method of printing, comprising the steps of:

mounting a burster module to a printer assembly at a single sheet storage module mounting location in lieu of the single sheet storage module with a burster outlet substantially aligned with a printer inlet;

feeding continuous printable stock to a burster inlet burster module, separating with the burster module the continuous printable stock received at the burster inlet into separate bursted sheets; and feeding the separate bursted sheets from the burster outlet to the printer inlet for transport to the printer for printing.

15. The method of claim 14 including the steps of releasably mounting a carrier form outlet guide to the printer assembly in lieu of a printer outlet tray;

guiding with the outlet guide the bursted separate sheets from the printer outlet to a card inserter.

16. The method of claim 15 in which said step of guiding includes the step of restraining with the guiding means the bursted separate sheets to travel along an underlying floor adjacent an open end of the guide member.

17. The method of claim 15 including the step of remotely reading information from the bursted separate carrier as the bursted carrier moves along the carrier form outlet guide.

18. The method of claim 14 including the step of achieving proper alignment of the burster outlet with the printer inlet by means of mating alignment members including a pair of alignment members normally employed to mount the single sheet storage module.

19. A method of converting a conventional single sheet printer to function as part of an in-line card insertion system for inserting cards into matching carrier forms, comprising the steps of:

mounting a carrier form burster module to the printer at a mounting location for a conventional single sheet feeder module otherwise releasably attached with the single sheet printer, said carrier form buster module adapted to separate individual carrier forms from a supply of continuous stock and feed the separate carrier forms to the printer; and mounting a removable carrier form outlet guide especially adapted for guiding printed card carrier forms to a card inserter carrier form inlet at a mounting location for and in lieu of a conventional printer outlet tray otherwise releasably attached with the printer.

* * * * *